US006190771B1

(12) United States Patent
Chen et al.

(10) Patent No.: US 6,190,771 B1
(45) Date of Patent: Feb. 20, 2001

(54) FUSER ASSEMBLY WITH DONOR ROLLER HAVING REDUCED RELEASE AGENT SWELL

(76) Inventors: Jiann H. Chen; Stephen V. Davis; Robert A. Lancaster, all of Eastman Kodak Company 343 State St., Rochester, NY (US) 14650

( * ) Notice: Under 35 U.S.C. 154(b), the term of this patent shall be extended for 0 days.

(21) Appl. No.: 09/221,345

(22) Filed: Dec. 28, 1998

(51) Int. Cl.[7] ..... D02G 3/00

(52) U.S. Cl. ..... 428/375; 428/383; 428/391; 428/398; 428/401; 428/447; 428/448; 492/56; 492/59

(58) Field of Search ..... 428/375, 378, 428/379, 380, 381, 383, 391, 398, 400, 401, 421, 447, 448, 906; 492/56, 59

(56) References Cited

U.S. PATENT DOCUMENTS

| | | | |
|---|---|---|---|
| 4,029,827 | | 6/1977 | Imperial et al. . |
| 4,101,686 | | 7/1978 | Strella et al. . |
| 4,185,140 | | 1/1980 | Strella et al. . |
| 4,257,699 | | 3/1981 | Lentz . |
| 4,264,181 | | 4/1981 | Lentz et al. . |
| 4,272,179 | | 6/1981 | Seanor . |
| 4,659,621 | | 4/1987 | Finn et al. . |
| 4,777,087 | | 10/1988 | Heeks et al. . |
| 4,807,341 | | 2/1989 | Nielsen et al. . |
| 5,061,965 | | 10/1991 | Ferguson et al. . |
| 5,141,788 | | 8/1992 | Badesha et al. . |
| 5,166,031 | | 11/1992 | Badesha et al. . |
| 5,269,740 | | 12/1993 | Fitzgerald et al. . |
| 5,292,562 | | 3/1994 | Fitzgerald et al. . |
| 5,292,606 | | 3/1994 | Fitzgerald . |
| 5,336,539 | | 8/1994 | Fitzgerald . |
| 5,534,347 | | 7/1996 | Chen et al. . |
| 5,548,720 | | 8/1996 | Fujii . |
| 5,803,887 | * | 9/1998 | Fukunaga ..... 492/59 |
| 5,846,643 | * | 12/1998 | Badesha et al. ..... 428/323 |
| 5,937,257 | * | 8/1999 | Condello et al. ..... 399/325 |

* cited by examiner

*Primary Examiner*—William Krynski
*Assistant Examiner*—B. Shewareged

(57) ABSTRACT

In a fusing assembly for fixing toner to a receiver and having a fuser roller and a pressure roller forming a fixing nip, a metering roller, a polymeric release agent is applied to the metering roller and a release agent donor roller for receiving polymeric release agent from the metering roller and applying it to the surface of the fusing roller, the release agent donor roller comprising an outer layer including a silicone material selected so that its swelling in 1000 cts poly (dimethylsiloxane) is less than 6% by weight.

9 Claims, 2 Drawing Sheets

FUSER ASSEMBLY WITH DONOR ROLLER HAVING REDUCED RELEASE AGENT SWELL

FIELD OF THE INVENTION

The present invention relates to fuser apparatus for use in electrostatographic printing apparatus, which includes an improved low swell release agent donor roller.

BACKGROUND OF THE INVENTION

The present invention relates generally to an electrostatographic printing apparatus and more particularly to a fusing system for fixing toner material to support substrate. In particular the present invention relates to a release agent donor roller for a toner fixing station in such apparatus.

In the process of xerography, a light image of an original to be copied is typically recorded in the form of an electrostatic latent image upon a photosensitive member with subsequent rendering of the latent image visible by the application of electroscopic marking particles commonly referred to in the art as toner. The residual toner image can be either fixed directly upon the photosensitive member or transferred from the member to another support or receiver, such as a sheet of plain paper with subsequent affixing of the image thereto.

In order to fix or fuse the toner material onto a support member permanently by heat, it is necessary to elevate the temperature of the toner material to a point at which constituents of the toner material coalesce and become tacky. This action causes the toner to flow to some extent into the fibers or pores of the support members or otherwise upon the surfaces thereof. Thereafter, as the toner material cools, solidification of the toner material occurs causing the toner material to be bonded firmly to the receiver.

One approach to thermal fusing of toner material images onto the supporting substrate has been to pass the receiver with the unfused toner images thereon between a pair of opposed roller members at least one of which is heated. During operation of a fusing system of this type, the receiver to which the toner images are electrostatically adhered is moved through the nip formed between the rolls with the toner image contacting the fuser roller thereby to affect heating of the toner images within the nip. Typical of such fusing devices are two roller systems wherein the fusing roller is coated with an adhesive material, such as a silicone rubber or other low surface energy elastomer or, for example, tetrafluoroethylene resin sold by E. I. DuPont De Nemours under the trademark Teflon. The silicone rubbers which have been used as the surface of the fuser member can be classified into three groups according to the vulcanization method and temperature, i.e., room temperature vulcanization silicone rubber referred hereinafter referred to as RTV silicone rubber, liquid silicone rubber to as LSR rubber, and high temperature vulcanization type silicone rubber referred to as HTV rubber. All these silicone rubbers or elastomers are well known in the art and are commercially available.

In these fusing systems, however, since the toner image is tackified by heat it frequently happens that a part of the image carried on the receiver will be retained by the heated fuser roller and not penetrate into the receiver surface. This tackified material will stick to the surface of the fusing roller and come in contact with the subsequent receiver sheet bearing a toner image to be fused. A tackified image which has been partially removed from the first sheet, may transfer to the second sheet in non-image portions of the second sheet. In addition, a portion of the tackified image of the second sheet may also adhere to the heated fuser roller. In this way and with the fusing of subsequent sheets of substrates bearing the toner images, the fuser roller may be thoroughly contaminated. In addition, since the fuser roller continues to rotate when there is no substrate bearing a toner image to be fused there between, toner may be transferred from the fuser roller to the pressure roll. These conditions are referred to in the copying art as "offset". Attempts have been made to control the heat transfer to the toner and thereby control the offset. However, even with the adhesive surfaces provided by the silicone elastomers, this has not been entirely successful.

It has also been proposed to provide toner release agents such as silicone oil, in particular, poly(dimethylsiloxane), which is applied on the fuser roller to a thickness of the order of about 1 micron to act as a polymeric release agent. These materials possess a relatively low surface energy and have been found to be materials that are suitable for use in the heated fuser roller environment. In practice, a thin layer of poly(dimethylsiloxane) (silicone oil) release agent is applied to the surface of the heated roller to form an interface between the roller surface and the toner image carried on the support material. Thus, a low surface energy, easily parted layer is presented to the toners that pass through the fuser nip and thereby prevents toner from offsetting to the fuser roller surface.

Some recent developments in fuser rollers, polymeric release agents and fusing systems are described in U.S. Pat. No. 4,264,181 to Lentz et al., U.S. Pat. No. 4,257,699 to Lentz and U.S. Pat. No. 4,272,179 to Seanor. These patents describe fuser rollers and methods of fusing thermoplastic resin toner images to a substrate wherein a polymeric release agent having functional groups is applied to the surface of the fuser roller. The fuser roller comprises a base member having an elastomeric surface with a metal containing filler therein which has been cured with a nucleophilic addition curing agent. Exemplary of such fuser roller is an aluminum base member with a poly(vinylidenefluoride-hexafluoropropylene) copolymer cured with bisphenol curing agent having lead oxide filler dispersed therein and utilizing a mercapto functional polyorganosiloxane oil as a polymeric release agent. In those fusing processes, the polymeric release agents have functional groups (also designated as chemically reactive functional groups) which interact with the metal containing filler dispersed in the elastomer or resinous material of the fuser roller surface to form a thermally stable film which releases thermoplastic resin toner and which prevents the thermoplastic resin toner from contacting the elastomer material itself. The metal oxide, metal salt, metal alloy or other suitable metal compound filler dispersed in the elastomer or resin upon the fuser roller surface interacts with the functional groups of the polymeric release agent. Preferably, the metal containing filler materials do not cause degradation of or have any adverse effect upon the polymeric release agent having functional groups. Because of this reaction between the elastomer having a metal containing filler and the polymeric release agent having functional groups, excellent release and the production of high quality copies are obtained even at high rates of speed of electrostatographic reproducing machines.

While the mechanism involved is not completely understood, it has been observed that when certain polymeric fluids having functional groups are applied to the surface of a fusing roller having an elastomer surface with a metal oxide, metal salt, metal, metal alloy or other suitable metal compounds dispersed therein there is an interaction (a chemical reaction, coordination complex, hydrogen bonding or other mechanism) between the metal of the filler in the elastomer and the polymeric fluid having functional groups so that the polymeric release agent having functional groups in the form of a liquid or fluid provides an excellent surface for release which having an excellent propensity to remain upon the surface of the fuser roller. Regardless of the mechanism, there appears to be the formation of a film upon the elastomer surface which differs from the composition of the elastomer and the composition of the polymeric release agent having functional groups. This film, however, has a greater affinity for the elastomer containing a metal compound than the toner and thereby provides an excellent release coating upon the elastomer surface. The release coating has a cohesive force which is less than the adhesive forces between heated toner and the substrate to which it is applied and the cohesive forces of the toner. The interaction between the functional group of the polymeric release agent and the metal of the elastomer containing metal leads to an overall diminution of the critical or high surface energy of the metal in the metal containing filler. The reaction of a functional group of the polymeric release agent is especially useful for nonsilicone elastomer based fusing systems; however, advantages can also be seen in the use of funtionalized polymeric release agent with silicone elastomer based fusing rollers in offset reduction.

U.S. Pat. Nos. 4,029,827, to Imperial et al., U.S. Pat. No. 4,101,686 to Strella et al. U.S. Pat. No. 4,185,140 also to Strella et al also disclose the use of polymeric release agents having functional groups which interact with the fuser roller to form a thermally stable renewable self cleaning layer having superior release properties for electroscopic thermoplastic resin toners. In particular, U.S. Pat. No. 4,029,827 is directed to the use of polyorganosiloxane having mercapto functionality as polymeric release agents. U.S. Pat. Nos. 4,101,686 and 4,185,140 are directed to polymeric release agents having functional groups such as carboxy, hydroxy, epoxy, amino, isocyanate, thioether and mercapto groups as release fluids.

According to prior art techniques the toner release agents may be applied to the fuser roller by several delivery mechanisms including wicking, impregnating webs and by way of a release agent donor roller which may comprise an EPDM (terpolymer elastomer made from ethylene, propylene and diene monomer) core with a thin sleeve of Teflon, PFA (E.I. DuPont De Nemours) which is an independent extruded thin sleeve of material which is bonded onto the core.

The use of such a sleeve is very expensive and the manufacturing of such a donor roll, is tedious and inefficient, the yield being relatively low since so many of the sleeves are damaged during manufacture. Furthermore, in a fusing assembly such as that illustrated in FIG. 1, which will be described in greater detail hereinafter, such a sleeved release agent donor roller is ineffective in that since the release agent donor roller is driven by frictional engagement with the fuser roll, the hard Teflon PFA coating has a relatively low coefficient of friction difficulties are presented in providing the necessary driving component.

Another technique has been with the use of a release agent donor roller made of a high temperature vulcanized silicone rubber material. Another development is described in U.S. Pat. No. 4,659,621 to Finn et al. wherein a release agent donor roller is described as having a conformable donor surface comprising the crosslinked product of at least one addition curable vinyl terminated or vinyl pendant polyorganosiloxane, a polyfunctional silicone hydride crosslinking agent crosslinking catalyst and finely divided filler. While these silicone elastomer donor rolls have been commercially successful in some commercial applications they suffer from certain difficulties in that they tend to swell by being in contact with a silicone oil release agent which migrates or is absorbed into the silicone rubber. While a small degree of swelling may be acceptable if it is uniform, failure of such rolls has been observed by excessive swelling over a period of operation wherein the release agent donor roller may actually be twice the original size. Under such circumstances, the silicone rubber release agent donor roller may no longer function in providing a uniform layer of release fluid to the fuser roll. Further, while donor rolls described in U.S. Pat. No. 4,659,621 have attractive oil delivery capabilities in that they are capable of transporting sufficient quantities of functional polymeric release agent to the fuser roller to form the interfacial barrier layer between the fuser roller and the toner they also tend to swell with the polymeric release agent penetrating the rubber whereby there may be an interchange of the poly(dimethylsiloxane) release agent with the poly(dimethylsiloxane) in the silicone rubber network leading to breakdown of the network and a lower crosslinked network thereby reducing the toughness of the silicone rubber barrier layer as more polymeric release agent penetrates the surface. This difficulty is particularly pronounced when operating at temperatures in excess of 300° F. and at very high printing speeds of the order of 135 copies per minute. Failure is observed by a mechanism referred to as chunking wherein pieces actually separate from the surface of the roller because the rubber has such low toughness. These small pieces can actually show up on a copier print. As a result of this chunking process the delivery of polymeric release agent is no longer uniform to the fuser roll. An additional failure mode is referred to as debonding wherein the swelling of the silicone rubber has become so significant that it actually delaminates from the core of the donor roll. A similar situation has been described to occur to poly(dimethylsiloxane) based fuser rollers in U.S. Pat. No. 4,777,087 by Heeks et al.

Another recent development is described in U.S. Pat. No. 5,061,965 to Ferguson et al. This describes the use of a release agent donor roller made of a base roller, an intermediate comfortable silicone elastomer layer, and an elastomer release layer comprising poly(vinylidene fluoride-hexafluoropropylene-tetrafluoroethylene) where the vinylidene fluoride is present in an amount <40 mole %, a metal oxide present in an amount sufficient to interact with polymeric release agent having functional groups to transport a sufficient amount of polymeric release agent to provide an interfacial barrier layer between the fusing surface and the toner. This release agent donor roller suffers from the polymeric release agent wetting capability between the nonfunctional PDMS release agent and the nonreactive release agent donor roller surface since the invention counts on the polymeric release agent having functional groups to react with the metal oxide which is dispersed in the fluoroelastomer layer.

A more recent development described in U.S. Pat. Nos. 5,141,788 and 5,166,031 to S. Badesha wherein a release agent donor roller comprising a supporting substrate having an outer layer of a surface grafted or volume grafted polyorganosiloxane formed by dehydrofluorination of said fluoroelastomer by nucleophilic dehydrofluorinating agent, followed by addition polymerization by the addition of an alkene functionalized polyorganosiloxane and a polymerization initiator. Fabricated release agent donor roller used for supplying conventional silicone oil release agent showing 4.3 million copies without failure. Although these rolls provide long life, non-oil swelling, and can be used with non-functional PDMS release agent, the manufacturing of such a release agent donor roller is tedious, inefficient, and expensive.

SUMMARY OF THE INVENTION

It is an object of the present invention to provide an improved release agent donor roller that has controlled swell when subject to a polymeric release agent.

A further object of the present invention is to provide a release agent donor roller which can be readily assembled and produces improved image quality when incorporated into a fusing assembly.

These objects are achieved in a fusing assembly for fixing toner to a receiver and having a fuser roller and a pressure roller forming a fixing nip, a metering roller, means for applying a polymeric release agent to the metering roller and a release agent donor roller for receiving polymeric release agent from the metering roller and applying it to the surface of the fusing roller, the release agent donor roller comprising an outer layer including a silicone material selected so that its swelling in 1000 cSt. poly(dimethylsiloxane) is less than 6% by weight.

An advantage of the present invention is that by decreasing the swell of the donor roller outer layer will decrease the tendency of such release agent donor roller outer layer to debond as well as maintaining the mechanical properties of the release agent donor roller outer layer.

An advantage of the present invention is that by reducing the swell caused by the polymeric release agent by varying the chemical structure, the release agent donor roller outer layer wear resistance can be improved resulting in a longer useful life.

Another advantage of the present invention is that it successfully reduces the swell of the donor roller outer layer caused by the polymeric release agent without sacrificing any of the release properties.

DETAILED DESCRIPTION OF THE PREFERRED EMBODIMENT

Figure 1:
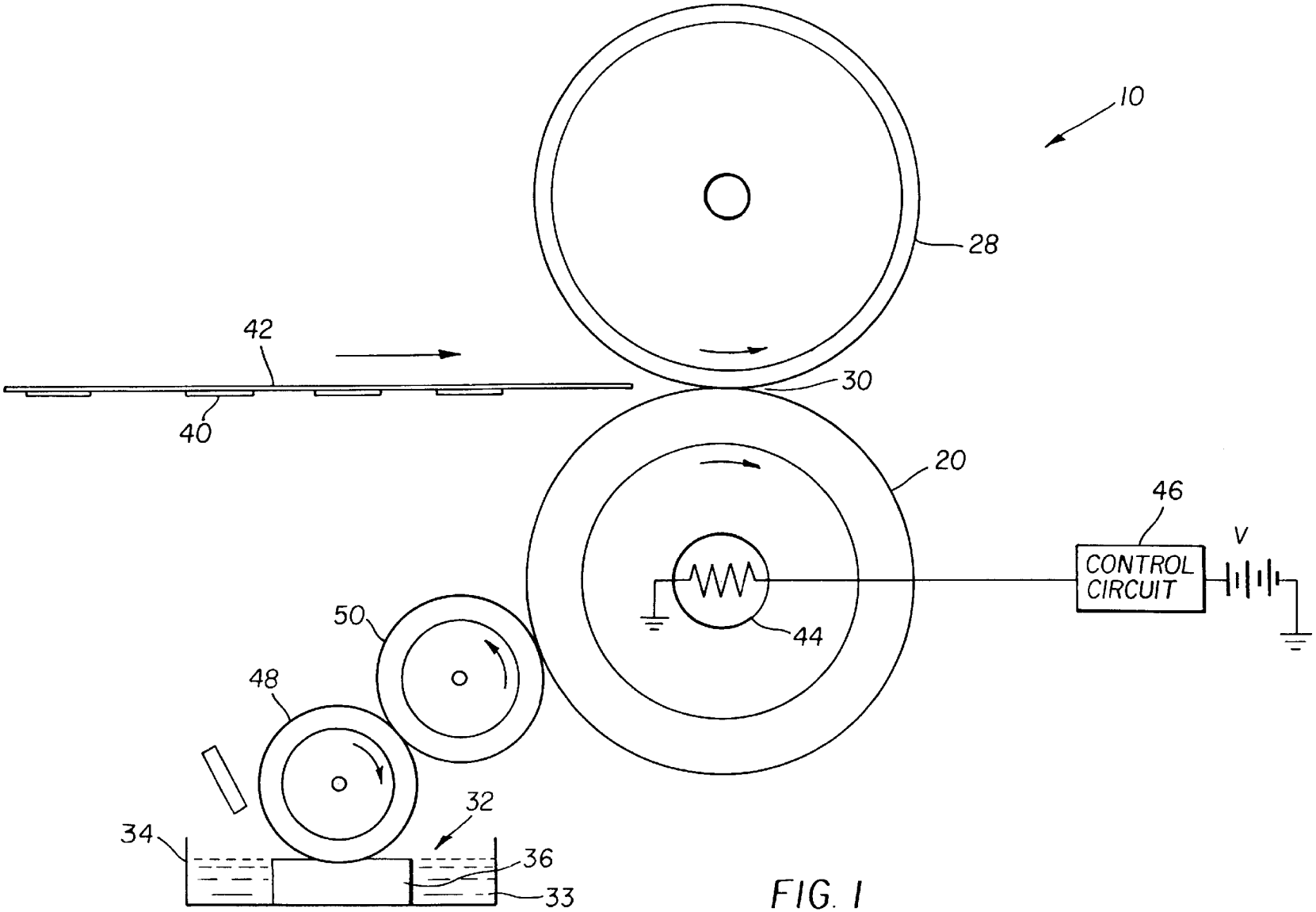
FIG. 1 is a schematic front cross-sectional view of a fuser assembly in accordance with the present invention.
Figure 2:
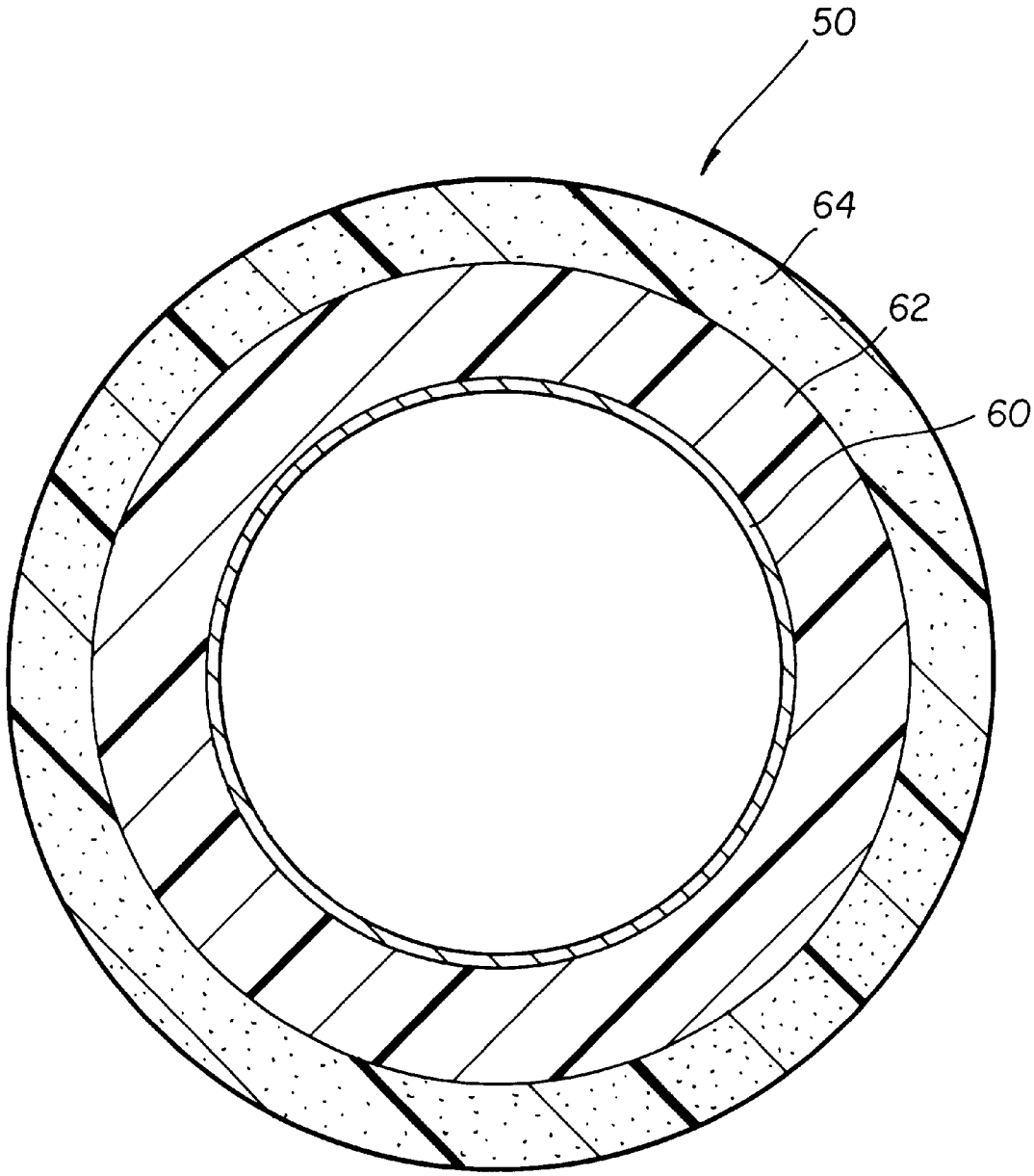
FIG. 2 is a cross-sectional view of the release agent donor roller of FIG. 1.

Referring now to FIG. 1 a fuser assembly 10 is shown which includes a fuser roller 20 and an elastomeric pressure roller 28 which form a nip 30. A supply of polymeric release agent 33 is shown provided in a polymeric release agent reservoir 34. The fuser roller 20 can be made of an elastomer either silicone or fluoropolymer based. Particulate imaging material 40 disposed on a receiver 42 is fused into the receiver 42 at the nip 30 by the application of heat and pressure. As shown a heating lamp 44 is connected to a control circuit 46. The heating lamp 44 is well known to those skilled in the art is provided inside the core of the fuser roller 20. Alternatively, the fuser roller 20 can be externally heated by a heated roller riding along the fuser roller 20. This external heat source may replace or merely assist the internal lamp 44. It will be understood depending on the particulate imaging material 40 that is used that only pressure need be applied to fuse particulate imaging material 40 into the receiver 42. A wicking device 32 shown in the form as a wick 36, absorbs the polymeric release agent 33 and is contacted by a metering roller 48 intermediate between the fuser roller 20 and the metering roller 48 is a release agent donor roller 50. The release agent donor roller 50 delivers polymeric release agent 33 to the particulate imaging material 40 to the receiver 42. A continuous supply of polymeric release agent 33 must be used which is approximately 1 to 20 mg per receiver 42, on which particulate imaging material 40 is fixed. This polymeric release agent 33 will be discussed in much more detail later.

The release agent donor roller 50 according to the present invention may comprise a shaft with a solid or hollow cylinder about 8 millimeters to 22 millimeters in diameter and a conformable donor surface coating from 3 about to 7 millimeters in thickness. The surface coating may be even thicker if desired to adjust for certain nip characteristics. Typically the rolls are from about 12 to 18 inches in length.

The release agent donor roller 50 is typically in the configuration of an economical, highly reliable, long life cylindrical roller which is conformable with a fuser roller 20 and provides uniform delivery of a sufficient amount of polymeric release agent 33 which can have functional group including hydride, amino, or mercapto groups to provide an interfacial barrier layer between the fusing surface and the toner. By selecting the structure of the release agent donor roller 50 and materials of the release agent donor roller outer layer 64 according to the present invention the positive properties of the individual components are accentuated while the negative properties are minimized. Thus, as previously described while traditional silicone elastomer rolls as release agent donor rollers 50 on their own tend to swell resulting in earlier failure by providing controlled polymeric release agent donor roller outer layer 64 over the intermediate layer 62, the polymeric release agent 33 is restricted from penetrating into the bulk of the release agent donor roller 50 eliminating early failure from swelling. Furthermore, with the bulk of the release agent donor roller 50 being the intermediate layer 62 it provides the necessary conformability to the fuser roller 20 to deliver a substantially uniform quantity of release agent 33 across the surface of the fuser roller 20 it being noted that a layer of the controlled polymeric release agent swell layer 64 of the same thickness might not be as conformable with the fuser roller 20.

In accordance with the present invention a long life, controlled polymeric release agent donor roller 50 and a fusing assembly 10 of the type wherein a nonfunctional or a functional polymeric release agent 33 is applied to the surface of a fuser roller 20 is provided by a controlled release agent donor roller 50. The controlled release agent donor roller 50 includes a base member 60, an intermediate layer 62 which is conformable and is disposed over the base member 60 and the release agent donor roller outer layer 64 disposed over the intermediate layer 62. In the event of the release agent donor roller outer layer 64 is of appropriate hardness and mechanical properties described later, the intermediate layer 62 can be composed of the same material as the release agent donor roller outer layer 64.

In another aspect of the present invention An oil-barrier layer can be included disposed over the intermediate layer 62 by coating an underlying silicone elastomer, coated directly or indirectly on a cylindrical core, with a composition formed by compounding a mixture comprising a fluorocarbon copolymer, a fluorocarbon-curing agent, a reactive polyfunctional poly($C_{(1-6)}$alkyl)phenylsiloxane polymer, one or more fillers and an accelerator for promoting crosslinking between the curing agent and the fluorocarbon copolymer as described in commonly assigned U.S.

Pat. No. 5,534,347. Other candidates for oil barrier layer include most heat stable materials having little or no swell caused by polymeric release agents. The release agent donor roller outer layer 64 would then be disposed over the oil barrier layer.

The release agent donor roller outer layer 64 includes:

(a) a crosslinkable poly(dialkylsiloxane) incorporating an oxide, wherein the poly(dialkylsiloxane) has a weight-average molecular weight before crosslinking of about 1,000 to 90,000;

(b) one or more crosslinkable poly(siloxanes) selected from the group consisting of poly(diarylsiloxane), poly (arylalkylsiloxanes) or mixtures thereof wherein the (diaryllsiloxane) or poly(arylalkylsiloxane) has a weight-average molecular weight before crosslinking of about 1,000 to 90,000.

(c) a silicone T-resin;

(d) at least one silane crosslinking agents; and (e) wherein the weight-average molecular weight of the mixture of poly(dialkylsiloxane) and poly(siloxane) is about 5,000 to 80,000.

In particular the present invention provides a release agent donor roller 50 comprising an outer layer including a silicone material selected so that its swelling in 1000 cSt. poly(dimethylsiloxane) is less than 6% by weight.

In general there are two methods for decreasing the swell caused by the polymeric release agent. The first is to add inert filler to the material. The mechanism is simply the displacement of polymer resulting in a reduced polymer to swell relationship. The disadvantage of this approach is that filler is generally not a good releasing surface which leads to greater contamination and offset. The second and preferred method is to adjust the swell characteristics of the base polymer by affecting such properties as crosslink density and compatibility of the material with the polymeric release agent. In general the crosslink density is adjusted by the molecular weight of the component resins. The compatibility of the base polymer to the polymeric release agent 33 can be accomplished through changing the chemical structure of either the fuser roller outer layer such as U.S. Pat. No. 4,807,341 or the polymeric release agent 33. Changing the chemical structure of the polymeric release agent 33 is in general costly as it is a consumable. In general changing the chemical structure of the fuser roller 20 results in higher contamination and offset.

In a further aspect of the present invention the intermediate silicone elastomer layer comprises the crosslinked product of a mixture of at least one polyorganosiloxane having the formula:

$$A—[Si(CH_3)R^1O]_n[Si(CH_3)R^2O]_m—D$$

where $R^1$ and $R^2$ may be any of hydrogen or unsubstituted alkyl, alkenyl or aryl having less than 19 carbon atoms or fluorosubstituted alkyl having less than 19 carbon atoms, each of A and D may be any of hydrogen, methyl, hydroxyl or vinyl groups and m and n are both integer numbers defining the number of repeat units and independently range from 0 to 10,000; crosslinking agent and crosslinking catalyst.

In a further aspect of the present invention the intermediate layer 62 is from about 0.5 millimeters to about 7.5 millimeters thick and the release agent donor roller outer layer 64 is from about 0.0125 to about 0.125 mm in thickness. In a further aspect of the present invention the release agent donor roller 50 as a hardness greater than 30 Shore A.

The outer layer of the fuser roller 20 of the invention includes a crosslinked poly(dialkylsiloxane) having at least one oxide. The fillers are an oxide or mixture of oxides. Typical oxides include metal oxides such as aluminum oxide, iron oxide, tin oxide, zinc oxide, copper oxide and nickel oxide. Silica (silicon oxide) can also be used. Other silicone resins is added being one or more crosslinkable poly(diarylsiloxane), poly(arylalkylsiloxanes) or mixtures thereof. An additional silicone T-resin is added to the crosslinkable poly(dialkylsiloxane) as well as silane crosslinking agents. Examples of suitable materials for a crosslinked poly(dialkylsiloxane) incorporating an oxide, are poly(dimethylsiloxane) having a weight-average molecular weight before crosslinking of about 5,000 to 80,000 of the outer layer are filled condensation-crosslinked PDMS elastomers disclosed in U.S. Pat. No. 5,269,740 (copper oxide filler), U.S. Pat. No. 5,292,606 (zinc oxide filler), U.S. Pat. No. 5,292,562 (chromium oxide filler), U.S. Pat. No. 5,548,720 (tin oxide filler), U.S. Pat. No. 5,336,539, (nickel oxide).

Next, one or more crosslinkable poly(diarylsiloxane), poly(arylalkylsiloxanes) or mixtures thereof wherein the (diaryllsiloxane) or poly(arylalkylsiloxane) has a weight-average molecular weight before crosslinking of about 1,000 to 90,000 are added to the poly(dialkylsiloxane).

Silanol-terminated poly(dialkylsiloxane), poly (diarylsiloxane), and poly(arylalkylsiloxanes) polymers and methods of their preparation are well known. They are readily commercially available, e.g., from Huils America, Inc., (United Chemical) 80 Centennial Ave., Piscataway, N.J., U.S.A., and having the repeat unit structure:

Structure I

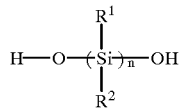

Structure II

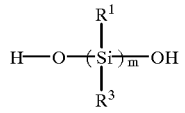

Structure III

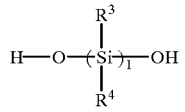

For purpose of the present invention l, m, and n are integers such that the Structure I, Structure II, and Structure III polymers independently have a weight average molecular weight of from 1,000 to 90,000. $R^1$ and $R^2$ are independently alkyl groups such as methyl, ethyl, propyl, butyl, pentyl, and hexyl. $R^3$ and $R^4$ are independently aryl groups such as phenyl. The molecular weights are chosen such that the weight average molecular weight of the mixture of siloxane resins is between 5,000 and 80,000. If the molecular weight were below 5,000, the final crosslinked network would have a high crosslink density that would make the material too hard and brittle, and not resilient enough to serve practically.

The primary crosslinked poly(dialkysiloxane) material used for the Examples is Stycast® 4952, sold by Grace Specialty Polymers, Massachusetts. Stycast® 4952 is composed of a network-forming polymer that is a silanol-terminated (α,ω-hydroxy-) poly(dimethylsiloxane) (PDMS). The number of repeat units is such that the silanol-terminated PDMS (α,ω-dihydroxypoly (dimethylsiloxane)) has a weight average molecular weight of from 5,000 to 80,000. This composition includes the filler. The filler is between 55–70 wt % aluminum oxide and 5–15 wt % iron oxide particulate fillers. Polyethyl silicate (condensed tetraethylorthosilicate) is present as the crosslinking agent.

The second component of the outer layer is a silicone T-resin. A silicone T-resin as described in United Chemical catalog (page 280 5th edition) is a highly crosslinked material with the empirical formula (or repeat unit) $RSiO_{1.5}$ formed from polymerization of silsesquioxane monomers to form by nature an unordered structure. R can be any alkyl or aryl group including but not limited to methyl, phenylpropyl, phenyl, or phenylvinyl. The term "unordered structure" means that the organization of repeat units is substantially random. An example structure for a such formed silicone T-resin is shown below where • represents a repeat unit.

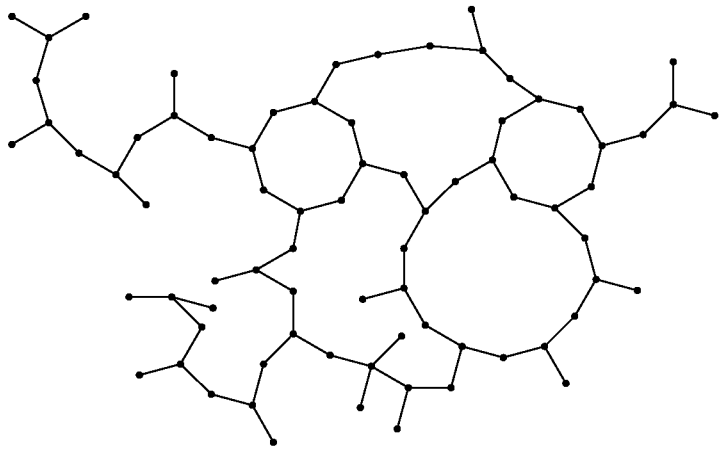

The presence of silicon T-resin in concentrations greater than 26% result in materials whose wear resistance is too low to allow for long roller life. Addition silicon T-resin in amounts less than 5% is insufficient to give the fusing performance benefits described in this invention.

The mixture of silanol terminated poly(dialkylsiloxane), poly(diarylsiloxane), and poly(arylalkylsiloxanes) polymers can be crosslinked with multifunctional silanes. The multifunctional silanes that can serve as crosslinking agents for the Structure I, II and III polymers are well known for this purpose. Each of such silanes comprises a silicon atom bonded to at least three groups that are functional to condense with the hydroxy end groups of the Structure (I) polymers to thereby create siloxane crosslinks through the silicon atom of the silane. The functional groups of the silanes can be, for example, acyloxy (R—COO—), alkenoxy ($CH_2$=C(R)O—), alkoxy (R—O—), dialkylamino ($R_2$ N—), or alkyliminoxy ($R_2$ C=N—O—) groups, wherein R represents an alkyl moiety. Some specific examples of suitable multifunctional silane crosslinking agents are methyltrimethoxysilane, tetraethoxysilane, methyltripropenoxysilane, methyltriacetoxysilane, methyltris(butanone oxime)silane, and methyltris (diethylamino)silane.

In addition to any of the above crosslinking agent being added, addition aryl-based silanes are added including phenyltrimethoxysilane and diphenyltrimethoxysilane where this additional crosslinking agent has the general formula a silane crosslinking agent containing at least one aryl group of the general formula $$R^1_xSi(OR^2)_{4-x}$$

where $R^1$ is aryl and $R^2$ is aryl or alkyl and x is an integer less than 4.

In the case where alkoxy functional groups are employed, the condensation crosslinking reaction is carried out with the aid of a catalyst, such as, for example, a titanate, chloride, oxide, or carboxylic acid salt of zinc, tin, iron, or lead. Some specific examples of suitable catalysts are zinc octoate, dibutyltin diacetate, ferric chloride, and lead dioxide.

Specific examples of useful catalysts for this polymer are dibutyltin diacetate, tin octoate, zinc octoate, dibutyltin dichloride, dibutyltin dibutoxide, ferric chloride, lead dioxide, or mixtures of catalysts such as CAT50® (sold by Grace Specialty Polymers, Massachusetts). CAT50® is believed to be a mixture of dibutyltin dibutoxide and dibutyltin dichloride diluted with butanol.

For the preferred embodiment, the various components of the composite material can have the following weight percentages:

(a) 10–45 wt % α,ω-hydroxy-poly(dialkylsiloxane) having a weight average molecular weight of from 1,000 to 90,000;

(b) 30–85 wt % oxide fillers, especially the combination of 55–70 wt % aluminum oxide and 5–15 wt % iron oxide;

(c) 5–50 wt % of one or more α,ω.-hydroxy-poly (diarylsiloxane) and poly(arylalkylsiloxane) polymers having a weight average molecular weight of from 1,000 to 90,000;

(d) 0.5–5 wt % crosslinking agent;

(e) 5–26 parts per 100 parts polymer silicone T-resin;

(f) 0–40 parts per 100 parts α,ω-hydroxy-poly (dialkylsiloxane); and (g) 0.05–2 wt % catalyst.

To form the release agent donor roller outer layer 64 of a fuser assembly 10 in accordance with the invention, the poly(dialkylsiloxane) and one of more poly(diarylsiloxane), poly(arylalkylsiloxanes) or mixtures thereof polymers, an excess of the stoichiometric amount of multifunctional silane to form crosslinks with all the hydroxy end groups, and the appropriate amount of filler are thoroughly mixed on a three-roll mill. The silicone T-resin is also incorporated at this time. The arylsilane is then be added at this time or prior to coating. If a catalyst is necessary, it is then added to the mix with thorough stirring. The mix is then degassed and injected into a mold surrounding the fuser member, e.g. roll, core to mold the material onto the core. The covered core remains in the mold for a time sufficient for some crosslinking to occur (e.g., 4 hours). The covered roller is then removed from the mold and heated to accelerate the remaining crosslinking.

The following Examples further define and describe donor rolls prepared by the present invention and illustrate preferred embodiment of the present invention. Unless otherwise indicated, all parts and percentages are by weight.

EXAMPLES

Example 1

100 parts Stycast® 4952 (a crosslinked poly (dimethylsiloxane) incorporating an oxide) was blended with 25 parts PS 090 obtained from United Chemical being a poly(dimethylsiloxane)-co-poly(diphenylsiloxane) containing 18–22 mole % phenyl groups. 3 parts of PO330 obtained from United Chemicals being phenyltrimethoxysilane and 5 parts D6010 also obtained from United Chemicals being diphenyldimethoxysilane were stirred into the mixture. CAT50® catalyst (a dibutyltindiacetate) was added at the rate of one part of catalyst to 200 parts by weight Stycast® 4952. The mixture was degassed and molded in the shape of a 90 mil×6 inch×6 inch slab. The slab was air cured 12 hours at 25° C. then demolded. The slab was the cured with a 12 hour ramp to 200° C. followed by an 18 hour hold at 200° C. The slab was then subjected to testing as will be described in more detail later.

Example 2

100 parts Stycast® 4952 (a crosslinked poly (dimethylsiloxane) incorporating an oxide) was blended with 50 parts PS 090 obtained from United Chemical being a poly(dimethylsiloxane)-co-poly(diphenylsiloxane) containing 18–22 mole % phenyl groups and was blended with 10 parts GE Tospearl 145 spherical fine white powder on a 3 roller mill. 3 parts of PO330 obtained from United Chemicals being phenyltrimethoxysilane and 5 parts D6010 also obtained from United Chemicals being diphenyldimethoxysilane were stirred into the mixture. CAT50® catalyst (a dibutyltindiacetate) was added at the rate of one part of catalyst to 200 parts by weight Stycast® 4952. The mixture was degassed and molded in the shape of a 90 mil×6 inch×6 inch slab. The slab was air cured 12 hours at 25° C. then demolded. The slab was the cured with a 12 hour ramp to 200° C. followed by an 18 hour hold at 200° C. The slab was then subjected to testing as will be described in more detail later.

Comparative Example 1

100 parts Stycast® 4952 (a crosslinked poly (dimethylsiloxane) incorporating an oxide) was blended with 10 parts PS 090 obtained from United Chemical being a poly(dimethylsiloxane)-co-poly(diphenylsiloxane) containing 18–22 mole % phenyl groups. 3 parts of PO330 obtained from United Chemicals being phenyltrimethoxysilane and 5 parts D6010 also obtained from United Chemicals being diphenyldimethoxysilane were stirred into the mixture. CAT50® catalyst (a dibutyltindiacetate) was added at the rate of one part of catalyst to 200 parts by weight Stycast® 4952. The mixture was degassed and molded in the shape of a 90 mil×6 inch×6 inch slab. The slab was air cured 12 hours at 25° C. then demolded. The slab was the cured with a 12 hour ramp to 200° C. followed by an 18 hour hold at 200° C. The slab was then subjected to testing as will be described in more detail later.

Comparative Example 2

100 parts Stycast® 4952 (a crosslinked poly (dimethylsiloxane) incorporating an oxide) was measured. CAT50® catalyst (a dibutyltindiacetate) was added at the rate of one part of catalyst to 200 parts by weight Stycast(® 4952. The mixture was degassed and molded in the shape of a 90 mil×6 inch×6 inch slab. The slab was air cured 12 hours at 25° C. then demolded. The slab was the cured with a 12 hour ramp to 200° C. followed by an 18 hour hold at 200° C. The slab was then subjected to testing as will be described in more detail later.

Testing of Release Agent Donor Roller Outer Layers

Wear

The wear rate test of compression-molded slabs was performed using a Norman Abrader Device (Norman Tool Inc., Ind.). For this test, the Abrader Device was modified by replacing the standard grommet wheel with an aluminum rod (1.1 inch in length and 0.625 inch in diameter), placing a renewable paper strip on the samples, and running the tests at about 350° F. Four 480-cycle tracks were made on each sample then averaged. The wear track depths were measured Federal 2000 surfanalyzer with a chisel stylus.

Oil Swell Polymeric release agent (oil) swell was measured by immersing a weighed sample in 1000 cs Dow Corning DC200 poly(dimethylsiloxane) for 7 days at 175° C. and calculating the weight gain.

Oil Wear

The wear test above was performed on a sample which had be soaked in 1000 cSt. poly(dimethylsiloxane) oil at 175° C. for 7 days.

Toner Release Test

The test samples are employed to evaluate the toner offset and release force characteristics of the polymeric release agent donor roller outer layer 64. Two samples are cut approximately 1-inch square of each example. One of these squares is left untreated by release agent (the dry sample). To the surface of the other sample is applied in unmeasured amount of 1000 cSt. polydimethysiloxane (the oil sample).

Each sample is incubated overnight at a temperature of 175° C. Following this treatment, the surface of each sample is wiped with dichloromethane. Each sample is then soaked in dichloromethane for one hour and allowed to dry before off-line testing for toner offset and release properties.

Each sample is tested in the following manner:

A one-inch square of paper covered with unfused polysytrene acrylate SB75 toner is placed in contact with a sample on a bed heated to 175° C., and a pressure roller set for 80 psi is locked in place over the laminate to form a nip. After 20 minutes the roller is released from the laminate.

The extent of offset for each sample is determined by microscopic examination of the sample surface following delamination. The following numerical evaluation, corresponding to the amount of toner remaining on the surface, is employed.

1 0% offset

1–2 0–20% offset

2–3 20–50% offset

3–4 50–90% offset

4–5 90–100% offset

Qualitative assessment of the force required for delamination of the paper from the sample is as follows:

1 low release force
2 moderate release force
3 high release force
The results are shown in the following table:

| Sample | swell (%) | Wear (mils) | Oil Wear (mils) | Dry Release/Offset | Oil Release/Offset |
|---|---|---|---|---|---|
| E1 | 4.6 | 7.1 | 5.7 | 1.1/1.2 | 1.1/1.2 |
| E2 | 0.4 | 8 | 6.2 | 1.2/1.2 | 1.3/1.2 |
| CE1 | 8.3 | 6.4 | 8.6 | 1/1.2 | 1/1.2 |
| CE2 | 7 | 5 | 7.9 | 1/1.5 | 1/1.5 |

Thus according to the present invention a new and improved release agent donor roller and fusing assembly have been provided. In particular, a release agent donor roller having controlled low polymeric release agent swell has been provided. This is achieved with a controlled polymeric release agent donor roller coating capable of transporting functional or nonfunctional polymeric release agent in sufficient quantities to the fuser roller while at the same time restricting penetration of the polymeric release agent into the intermediate silicone layer.

The release agent donor of this invention, particularly the fuser rollers, possess extremely desirable physical and mechanical characteristics as indicated in the tests results above. The fuser rollers have excellent toner release properties, without sacrificing toughness and abrasion resistance. The coating materials exhibit these desirable properties when they are prepared according to the process of this invention.

The invention has been described in detail with particular reference to certain preferred embodiments thereof, but it will be understood that variations and modifications can be effected within the spirit and scope of the invention.

Parts List
10 Fuser Assembly
20 Fuser Roller
28 Pressure Roller
30 Nip
32 Wicking Device
33 Polymeric Release Agent
34 Polymeric Release Agent Reservoir
36 Wick
40 Particulate Imaging Material
42 Receiver
44 Heating Lamp
46 Control Circuit
48 Metering Roller
50 Release Agent Donor Roller
60 Base Member
62 Intermediate Layer
64 Release agent donor roller outer layer

What is claimed is:

1. A fusing assembly for fixing toner to a receiver comprising a fuser roller and a pressure roller forming a fixing nip, a metering roller, means for applying a polymeric release agent to the metering roller and a release agent donor roller for receiving polymeric release agent from the metering roller and applying it to the surface of the fusing roller, the release agent donor roller comprising an outer layer including a silicone material selected so that its swelling in 1000 cSt. poly(dimethylsiloxane) is less than 6% by weight, such silicone material including:

(a) a crosslinked poly(dialkylsiloxane) incorporating an oxide, wherein the crosslinked poly(dialkylsiloxane) has a molecular weight-average before crosslinking of about 1,000 to 90,000;

(b) one or more crosslinked poly(siloxane) selected from the group consisting of poly(diarylsiloxane), poly (arylalkylsiloxanes) or mixtures thereof wherein the disrylsiloxane) or poly(arylalkylsiloxane) has a weight-average molecular weight before crosslinking of about 1,000 to 90,000;

(c) a silicone T-resin;

(d) at least one silane crosslinking agents; and (e) wherein the weight-average molecular weight of the mixture of poly(dialkylsiloxane) and poly(siloxane) is about 5,000 to 80,000.

2. The fusing assembly of claim 1 wherein the release agent donor roller includes a base member and an intermediate layer over the base member wherein the outer layer is provided over the intermediate layer, the intermediate layer comprising a crosslinked product of a mixture of at least one polyorganosiloxane having the formula:

$$A—[Si(CH_3)R^1O]_n[Si(CH_3)R^2O]_m—D$$

where $R^1$ and $R^2$ can be hydrogen or unsubstituted alkyl, alkenyl or aryl having less than 19 carbon atoms, or fluorosubstituted alkyl having less than 19 carbon atoms each of A and D may be any of hydrogen, methyl, hydroxyl or vinyl groups and m and n are both integer numbers defining the number of repeat units and independently range from 0 to 10,000; crosslinking agent and crosslinking catalyst.

3. The fusing assembly of claim 2 wherein the intermediate layer of the donor roller is from about 5.5 millimeters to about 6.5 millimeters thick and the release agent donor roller outer layer is from about 0.025 to about 0.1 millimeters in thickness.

4. The fusing assembly of claim 2 wherein the fuser roller is positively driven and the release agent donor roller is driven by frictional contact with the fuser roller.

5. The fuser assembly of claim 2 including a polymeric release agent sump and a metering roller for delivering release fluid from the sump to the release agent donor roller.

6. The fusing assembly of claim 2 wherein the release agent donor roller outer layer and intermediate layer are of the same composition including:

(a) a crosslinked poly(dialkylsiloxane) incorporating an oxide, wherein the poly(dialkylsiloxane) has a weight-average molecular weight before crosslinking of about 1,000 to 90,000;

(b) one or more crosslinked poly(siloxanes) selected from the group consisting of poly(diarylsiloxanes), poly (arylalkylsiloxanes) or mixtures thereof wherein the (diarylsiloxane) or poly(arylalkylsiloxane) has a weight-average molecular weight before crosslinking of about 1,000 to 90,000;

(c) a silicone T-resin;

(d) at least one silane crosslinking agent; and (e) wherein the weight-average molecular weight of the mixture of poly(dialkylsiloxane) and poly(siloxane) is about 5,000 to 80,000.

7. The fusing assembly of claim 2 wherein an oil barrier layer is disposed between the release agent donor roller outer layer and the intermediate layer.

8. A fusing assembly for fixing toner to a receiver comprising a fuser roller and a pressure roller forming a fixing nip, a metering roller, means for applying a polymeric release agent to the metering roller and a release agent donor roller for receiving polymeric release agent from the metering roller and applying it to the surface of the fusing roller, the release agent donor roller comprising an outer layer including a silicone material selected so that its swelling in 1000 cSt. poly(dimethylsiloxane) is less than 6% by weight, such silicone material including:

(a) a crosslinked poly(dialkylsiloxane) incorporating an oxide;

(b) one or more crosslinked poly(siloxane) selected from the group consisting of poly(diarylsiloxanes), poly (arylalkylsiloxanes) or mixtures thereof;

(c) a silicone T-resin present in an amount from 5 to 26 parts per 100 parts crosslinkable poly(dialkylsiloxane); and (d) at least one silane crosslinking agent present in an amount less than 40 parts per 100 parts crosslinkable poly(dialkylsiloxane).

9. A fusing assembly for fixing toner to a receiver comprising a fuser roller and a pressure roller forming a fixing nip, a metering roller, means for applying a polymeric release agent to the metering roller and a release agent donor roller for receiving polymeric release agent from the metering roller and applying it to the surface of the fusing roller, the release agent donor roller comprising an outer layer including a silicone material selected so that its swelling in 1000 cSt. poly(dimethylsiloxane) is less than 6% by weight, such silicone material including:

(a) a crosslinked poly(dialkylsiloxane) incorporating an oxide, wherein the crosslinked poly(dialkylsiloxane) has a molecular weight-average before crosslinking of about 1,000 to 90,000 wherein the crosslinked poly (dialkylsiloxane) incorporating an oxide, includes an ($\alpha$,$\omega$-hydroxy-) poly(dialkylsiloxane) with the repeat unit structure:

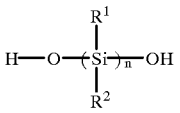

where n is an integer such that the weight average molecular weight is from 1,000 to 90,000, $R^1$ and $R^2$ are independently selected alkyl groups including methyl, ethyl, propyl, butyl, pentyl, or hexyl, and a polyethylsilicate crosslinking agent; and an oxide filler containing particles of aluminum oxide or iron oxide;

(b) one or more crosslinked poly(siloxane) selected from the group consisting of poly(diarylsiloxane), poly (arylalkylsiloxanes) or mixtures thereof wherein the disrylsiloxane) or poly(arylalkylsiloxane) has a weight-average molecular weight before crosslinking of about 1,000 to 90,000;

(c) a silicone T-resin;

(d) at least one silane crosslinking agents;

(e) wherein the weight-average molecular weight of the mixture of poly(dialkylsiloxane) and poly(siloxane) is about 5,000 to 80,000; and (f) wherein the polymeric release agent has a functional group that include hydride, amino, or mercapto.

* * * * *